US009821957B1

(12) United States Patent
Hurst

(10) Patent No.: US 9,821,957 B1
(45) Date of Patent: Nov. 21, 2017

(54) LOCKING APPARATUS FOR A REFUSE CONTAINER LID

(71) Applicant: David Robert Hurst, Hesperia, CA (US)

(72) Inventor: David Robert Hurst, Hesperia, CA (US)

(73) Assignee: David Robert Hurst, Hesperia, CA (US)

( * ) Notice: Subject to any disclaimer, the term of this patent is extended or adjusted under 35 U.S.C. 154(b) by 335 days.

(21) Appl. No.: 14/829,502

(22) Filed: Aug. 18, 2015

(51) Int. Cl.
*B65D 45/32* (2006.01)
*B65F 1/16* (2006.01)

(52) U.S. Cl.
CPC .... *B65F 1/1615* (2013.01); *B65F 2001/1669* (2013.01)

(58) Field of Classification Search
CPC ..... B65F 1/1615; B65F 1/1623; B65F 2001/1669
USPC ..... 220/319, 315, 324, 244, 827, 831, 832; 292/256.6, 256, 1, 137, 207
See application file for complete search history.

(56) References Cited

U.S. PATENT DOCUMENTS 5,094,358 A 3/1992 Serio, Sr.
5,415,314 A 5/1995 McCollum
5,474,341 A 12/1995 Putman et al.
5,599,050 A 2/1997 Tinsley
5,772,264 A 6/1998 Bettenhausen
6,666,485 B1 12/2003 Moret
7,597,365 B2 10/2009 Kreitzer
8,313,126 B2 11/2012 Ferkovich et al.
2009/0066092 A1* 3/2009 Reeb ..... B65F 1/1615 292/184
2013/0093196 A1 4/2013 Beer
2014/0238990 A1 4/2014 Banik et al.
2014/0299602 A1* 10/2014 Manssourian ..... B65F 1/1615 220/315
2015/0076834 A1* 3/2015 Hartl ..... G11B 15/68 292/170
2015/0084347 A1* 3/2015 Olsson ..... E05C 1/08 292/140
2016/0159570 A1* 6/2016 Reeb ..... B65F 1/1615 220/324
2017/0197787 A1* 7/2017 Reeb ..... B65F 1/1615

* cited by examiner

*Primary Examiner* — Fenn C Mathew
*Assistant Examiner* — Don M Anderson
(74) *Attorney, Agent, or Firm* — Plager Schack LLP; Mark H. Plager; Eric Liou

(57) ABSTRACT

A locking apparatus for use in securing a pivotably mounted lid of a refuse container includes a clamp assembly rotatably mounted to the container's handle and having a fork member, an arm coupled to the clamp assembly and in contact with the lid, a ring slidably mounted to the arm and clamp assembly, a mounting bracket coupled to the container's handle and connected to the clamp assembly by at least one spring, the mounting bracket having a base plate and an upper portion of the mounting bracket having at least one bumper, a rod fastener coupled to the base plate and fork member, and a rod member slidably mounted to the rod fastener. The rod member adjusts to permit the clamp assembly and arm to rotate such that the bumper releases the ring from the arm and clamp assembly upon contact, thereby enabling the container's lid to open.

10 Claims, 4 Drawing Sheets

LOCKING APPARATUS FOR A REFUSE CONTAINER LID

BACKGROUND

The embodiments herein relate generally to refuse containers.

Refuse containers are designed to collect trash or other items a user wishes to discard. Refuse containers often comprise a lid pivotably mounted to a container body. In most instances, a handle is affixed to the container body near the pivotal connection of the lid and body. One common problem faced by individuals is the unintentional opening of the lid, which may occur due to environmental factors such as wind, animals, or other causes. In addition, refuse containers sometimes tip over, which causes the lid to open and permit the stored trash to fall out to the ground.

There exists a variety of refuse container lid locking devices as disclosed in U.S. Pat. Nos. 5,094,358, 5,599,050, 8,313,126, 7,597,365, 6,666,485, 5,474,341, 5,415,314 and 5,772,264, and U.S. Patent Application Publications 2014/0238990 and 2013/0093196. However, these devices are limited because the majority of them are coupled to the front loading side of the container and require drilling holes into the container, thereby damaging it in the process. In addition, none of these devices are mounted to the handle of the refuse container. Instead, these devices are positioned on the front loading side of the container or other exposed area, which increases the chance the devices become damaged from contact with cars, refuse collection trucks, or the like.

As such, there is a need in the industry for a locking apparatus for a refuse container lid that overcomes the limitations of the prior art, which minimizes damage to both the container and apparatus. There is a further need for a locking apparatus that limits the rotation of the container lid when in an unlocked configuration.

SUMMARY

A locking apparatus for use in securing a lid of a refuse container in a closed position until access to the container is desired is provided. The refuse container is configured to be secured to a handle of the container located proximate a pivotal connection between the lid and a body of the container. The locking apparatus comprises a clamp assembly rotatably mounted to the handle of the container and comprising a fork member, an arm comprising a first end mechanically coupled to the clamp assembly and a second end in contact with the lid, a ring slidably mounted to the arm and clamp assembly, a mounting bracket mechanically coupled to the handle of the container and connected to the clamp assembly by at least one spring, the mounting bracket comprising a pair of generally C-shaped members oriented substantially parallel to each other and connected together by a base plate, wherein space between the C-shaped members is sufficiently large to permit the clamp assembly and the arm to extend therethrough, an upper portion of the mounting bracket comprising at least one bumper, a rod fastener comprising a first end coupled to the base plate of the mounting bracket and a second end coupled to the fork member, and a rod member slidably mounted to the rod fastener, wherein the rod member is disposed on the fork member to prevent movement of the arm and clamp assembly relative to the handle, thereby enabling the second end of the arm to secure the lid of the refuse container in the closed position, wherein the rod member is slidably adjusted away from the fork member to permit the clamp assembly and arm to rotate to permit the at least one bumper to release the ring from the arm and clamp assembly upon contact, thereby enabling the lid of the refuse container to be adjusted to an open position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
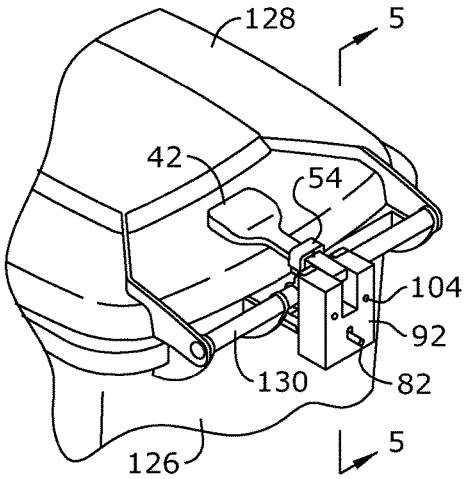
FIG. 1 depicts a perspective view of certain embodiments of the locking apparatus shown in use with container lid 128 closed.
Figure 2:
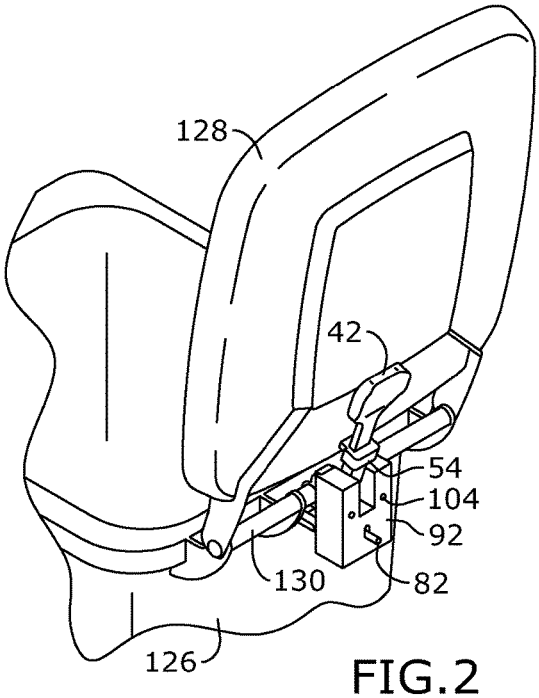
FIG. 2 depicts a perspective view of certain embodiments of the locking apparatus shown in use with container lid 128 opened.
Figure 3:
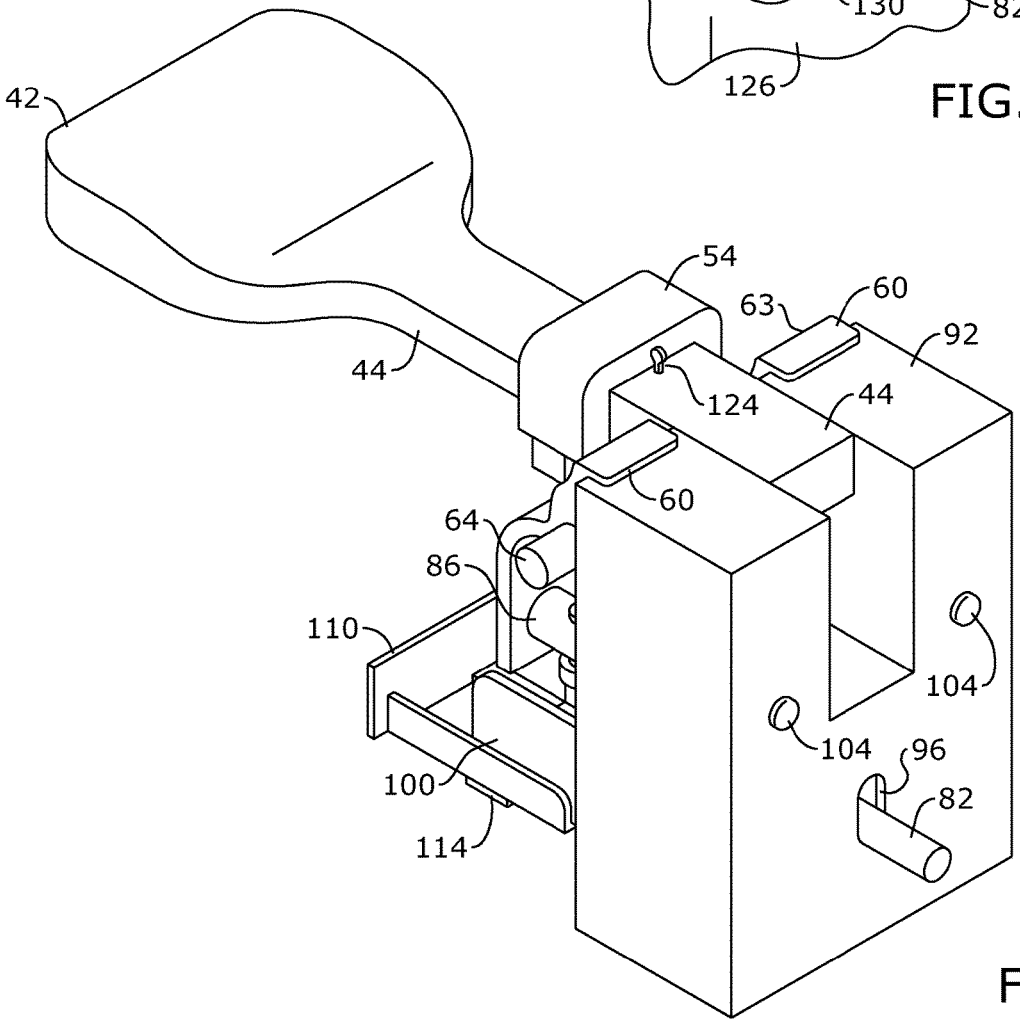
FIG. 3 depicts a perspective view of certain embodiments of the locking apparatus.
Figure 4:
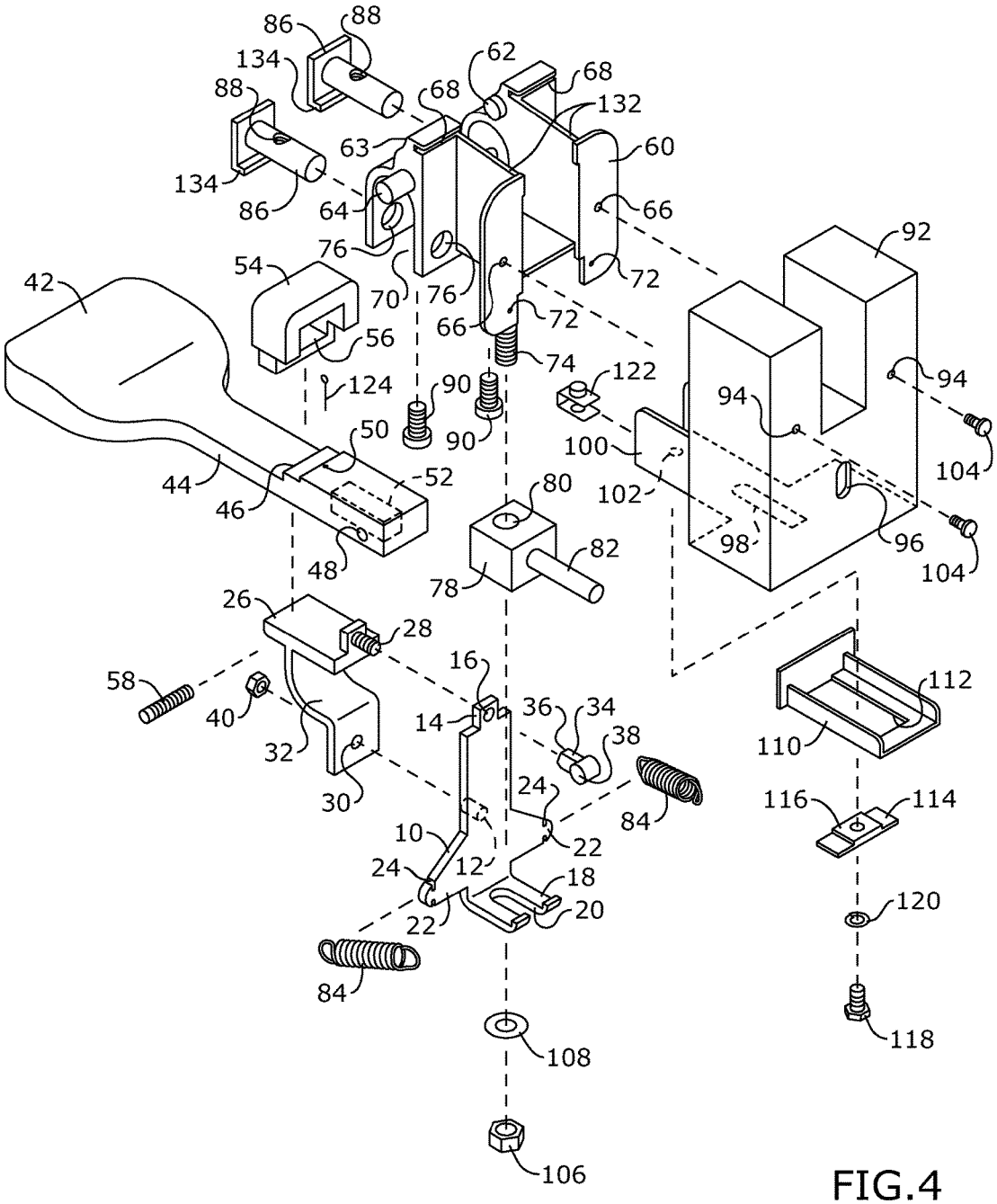
FIG. 4 depicts an exploded view of certain embodiments of the locking apparatus.

As depicted in FIGS. 1-2, the locking apparatus is configured for use with a refuse container, which comprises container body 126, container lid 128 and handle 130. Container lid 128 is pivotably mounted to container body 126 by hinge components known in the field. FIG. 1 depicts the locking apparatus in use securing container lid 128 in a closed and locked position. FIG. 2 depicts the locking apparatus in use illustrating container lid 128 in an open and unlocked position. As depicted in FIGS. 3-4, the locking apparatus generally comprises a clamp assembly comprising pivot bar 10 and slipper clamp 26, arm 44, lock ring 54, mounting bracket 60, override lever rod 82 and trim cover 92.

Pivot bar 10 comprises threaded stud 12, pivot bar tab 14, tab hole 16, fork 18 and a pair of wings 22. Fork 18 comprises a pair of tines separated by fork slot 20. Each tine comprises a lip at the end. Each wing 22 of pivot bar 10 comprises spring notches 24, which are configured to receive an end of spring 84. Slipper clamp 26 comprises threaded stud 28, handle slot 32 and bottom hole 30. Pivot bar 10 is mechanically coupled to slipper clamp 26. Specifically, threaded stud 28 of slipper clamp 26 is inserted through tab hole 16 and threaded stud hole 36 of offset coupling nut 34. Threaded stud 12 of pivot bar 10 is inserted through bottom hole 30 of slipper clamp 26 and secured into place by nut 40. Once slipper clamp 26 is coupled to pivot bar 10, handle 130 of the refuse container extends through handle slot 32 of slipper clamp 26. In this configuration, slipper clamp 26 and pivot bar 10 can rotate relative to handle 130.

Arm 44 comprises paddle 42, stepped section 46, hinge pin hole 48 and bottom notch 52. Arm 44 is secured to the clamp assembly by placing bottom notch 52 over threaded stud 28 and offset coupling nut 34 on slipper clamp 26. Hinge pin 58 is inserted into hinge pin hole 48 of arm 44 and hinge pin slot 38 of offset coupling nut 34. In this secured position, paddle 42 of arm 44 contacts the top of container lid 128. In one embodiment, arm 44 comprises cotter pin hole 50, which is configured to receive cotter pin 124. It shall be appreciated that the locking apparatus may be used without cotter pin 124.

Mounting bracket 60 is secured to handle 130 of the refuse container and comprises a pair of bracket webs 132 oriented substantially parallel to one another and connected by a base plate, lower lock ring bumpers 62, upper lock ring bumpers 63, handle slots 70, threaded guide rod 74 and pin holes 76. Each bracket web 132 comprises a generally C-shaped member comprising cover screw holes 66 and spring holes 72. Threaded guide rod 74 is coupled to the bottom of the connecting base plate positioned between bracket webs 132. In one embodiment, mounting bracket 60 comprises side extension 64.

Figure 5:
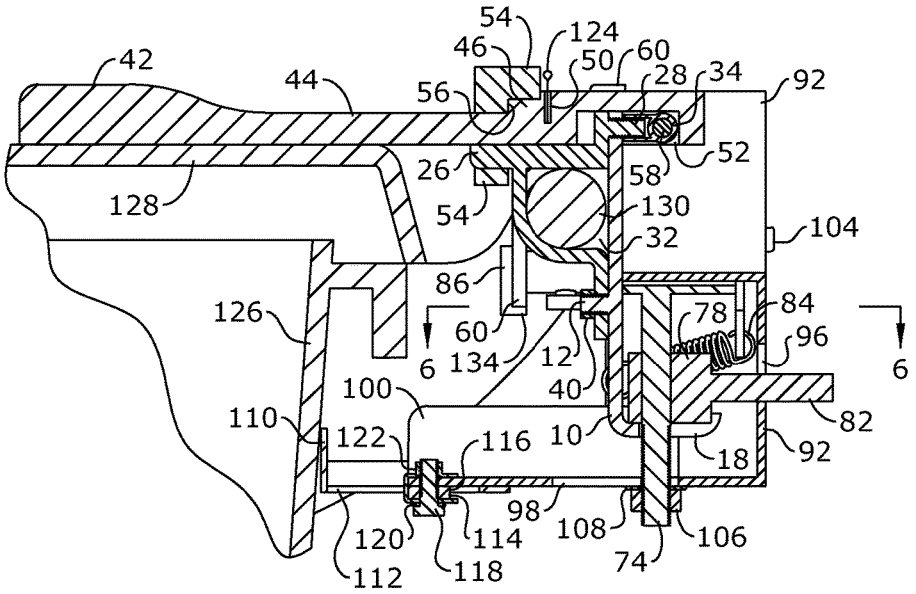
FIG. 5 depicts a section view of certain embodiments of the locking apparatus taken along line 5-5 in FIG. 1.
Figure 6:
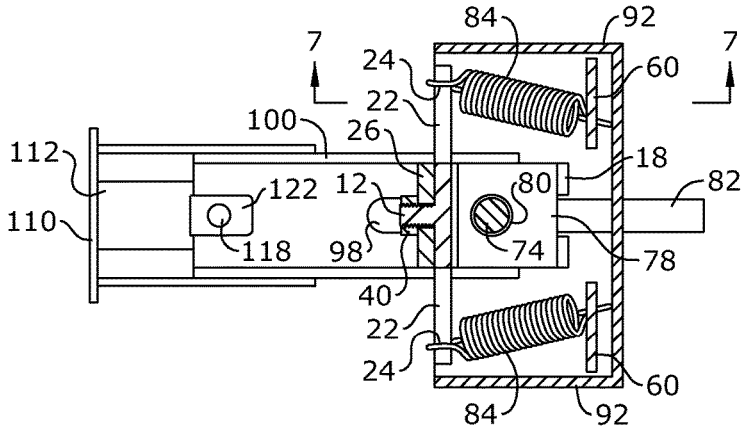
FIG. 6 depicts a section view of certain embodiments of the locking apparatus taken along line 6-6 in FIG. 5.
Figure 7:
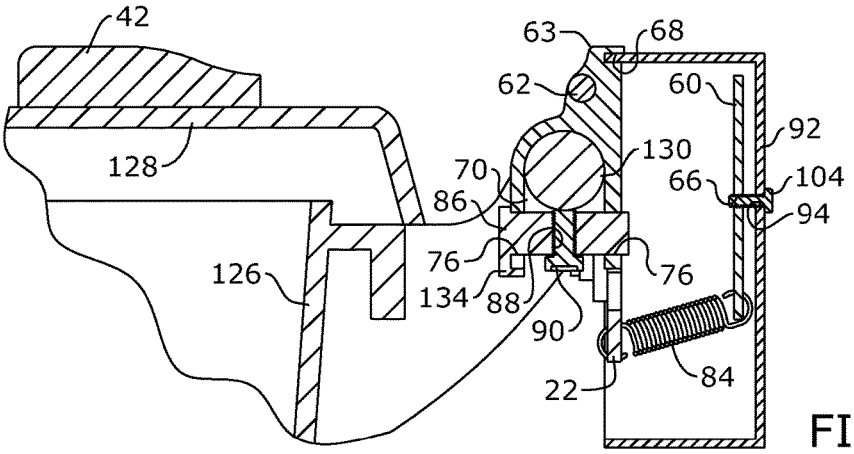
FIG. 7 depicts a section view of certain embodiments of the locking apparatus taken along line 7-7 in FIG. 6.

Mounting bracket 60 is secured to the refuse container by inserting handle 130 through handle slots 70 of the bracket. A pair of mounting pins 86 is used to secure mounting bracket 60 into place. Each mounting pin 86 comprises set screw hole 88 and anti-rotation tab 134. Mounting pins 86 are inserted through pin holes 76 of mounting bracket 60 below handle 130. Set screws 90 are inserted through set screw holes 88 to secure mounting pins 86 in place. As shown in FIG. 5, each anti-rotation tab 134 contacts mounting bracket 60 and enhances the stability of the component. Space between bracket webs 132 is sufficiently large for arm 44 and the clamp assembly to reside therein. Mounting bracket 60 is connected to pivot bar 10 by a pair of springs 84. First ends of springs 84 are coupled to spring notches 24 of pivot bar 10. Second ends of springs 84 are coupled to spring holes 72 on bracket webs 132. As will be apparent in the discussion that follows, springs 84 apply return forces to slipper clamp 26 and pivot bar 10 as they rotate.

Threaded guide rod 74 extends from the mounting bracket's base plate vertically through fork slot 20 of pivot bar 10. Override lever rod 82 comprises weight block 78 with guide rod hole 80. As depicted in FIG. 5, a smooth portion of threaded guide rod 74 is inserted through guide rod hole 80 of weight block 78. This permits override lever rod 82 to slidably adjust relative to threaded guide rod 74.

Trim cover 92 is secured to mounting bracket 60 to protect internal components of the locking apparatus from outside elements such as rain, snow or contaminants. Trim cover 92 comprises screw holes 94, override lever slot 96, post slot 98, brace tongue 100 and bolt hole 102. Edges of trim cover 92 are inserted into cover slots 68 of mounting bracket 60. Trim cover 92 is secured into place by inserting cover screws 104 through screw holes 94 and cover screw holes 66 on bracket webs 132. This assembly permits the bottom portion of threaded guide rod 74 to extend through post slot 98 of trim cover 92. The exposed end of threaded guide rod 74 is secured to trim cover 92 by post washer 108 and post nut 106. Override lever slot 96 permits override lever rod 82 to extend outside of trim cover 92.

In one embodiment, brace 110 may be secured to trim cover 92 to enhance stability of the locking apparatus. Brace 110 comprises brace slot 112 and is placed below brace tongue 100 of trim cover 92. Brace 110 is coupled to brace tongue 100 by rectangular washer 114, lock washer 120, bolt 118 and nut 122. More specifically, raised washer section 116 of rectangular washer 114 is inserted through brace slot 112 from the bottom. Bolt 118 is inserted through lock washer 120, rectangular washer 114, nut 122 and bolt hole 102 in brace tongue 100. This connection secures brace 110 to trim cover 92. As depicted in FIG. 5, brace 110 extends to contact a face of container body 126. This helps to maintain the locking apparatus in a stationary position relative to the refuse container.

To operate the locking apparatus, the components are secured to handle 130 of the refuse container as described above. FIGS. 1 and 5-7 depict the locking apparatus in use wherein container lid 128 is in a closed and locked position. In this locked position, lock ring 54 is slidably mounted around arm 44 and the top portion of slipper clamp 26 as shown in FIG. 5. Lock ring 54 comprises stepped slot 56, which fits over stepped section 46 of arm 44. In the locked position, paddle 42 applies a downward force to the top of container lid 128, thereby keeping it closed. Container lid 128 cannot rotate open because pivot bar 10 and slipper clamp 26 are prevented from rotating towards the refuse container. As depicted in FIG. 5, the placement of weight block 78 on top of fork 18 prevents any movement of the clamp assembly. Specifically, the lips of the fork tines wrap around weight block 78 and prevent fork 18 from rotating.

Figure 8:
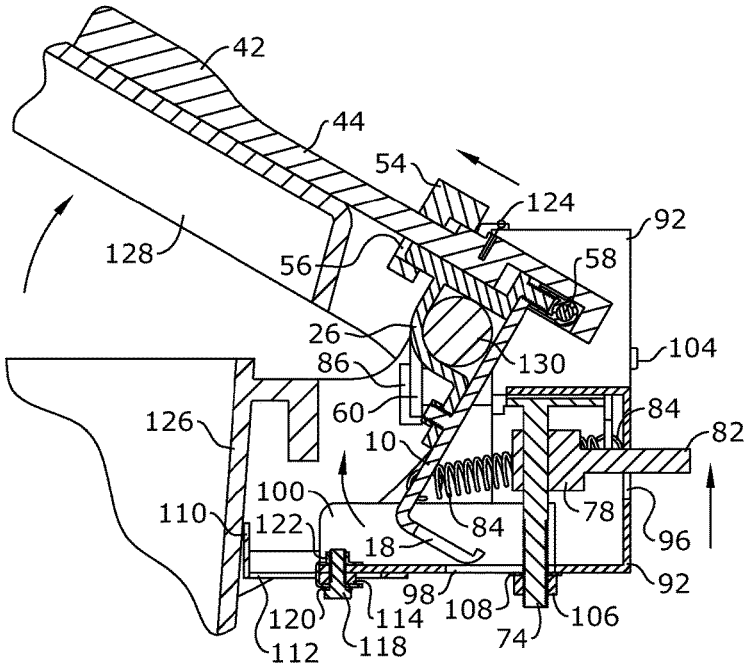
FIG. 8 depicts a section view of certain embodiments of the locking apparatus shown in use.
Figure 9:
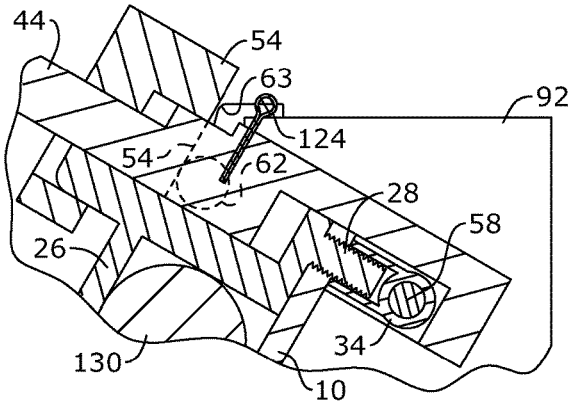
FIG. 9 depicts a section view of certain embodiments of the locking apparatus shown in use.
Figure 10:
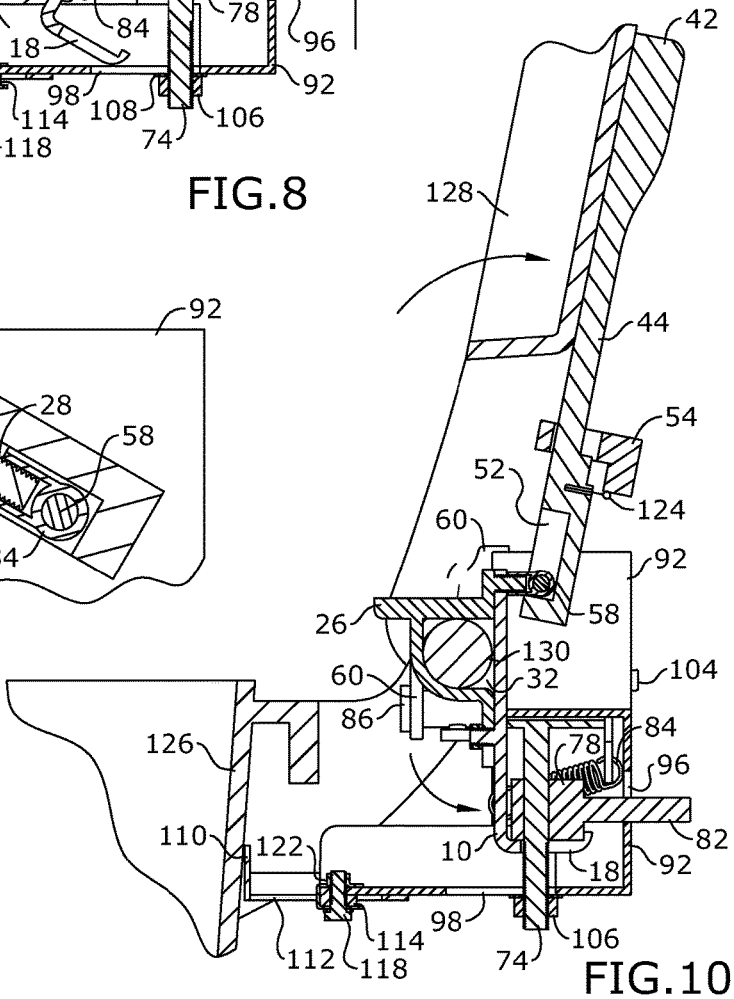
FIG. 10 depicts a section view of certain embodiments of the locking apparatus shown in use.

To unlock the locking apparatus, a user lifts override lever rod 82 until weight block 78 is above the lips of fork 18. As depicted in FIG. 8, this permits springs 84 to extend and allow pivot bar 10, slipper clamp 26 and container lid 128 to rotate. During this rotation, lower lock ring bumpers 62 and upper lock ring bumpers 63 of mounting bracket 60 contact lock ring 54 as shown in FIG. 9. This contact pushes lock ring 54 forward until it detaches from arm 44 and slipper clamp 26. Once lock ring 54 is detached, a user continues to rotate container lid 128 to the open position as shown in FIG. 10. At the same time, springs 84 compress and retract pivot bar 10 and slipper clamp 26 to the original position. In this unlocked position, the locking apparatus limits container lid 128 from completely rotating past a certain point.

The lock apparatus will keep container lid 128 unlocked until a user manually slides lock ring 54 around arm 44 and slipper clamp 26 as described above. Once the lock apparatus and container lid 128 are in the locked position, a user can alternatively manually slide lock ring 54 forward by hand to detach from arm 44 and slipper clamp 26, thereby permitting container lid 128 to open. Alternatively, the lock apparatus and container lid 128 can be unlocked by inverting the refuse container. This process is common with machine operated trash collection vehicles. Once the refuse container is inverted, gravity pulls override lever rod 82 and weight block 78 away from fork 18. This causes pivot bar 10 and slipper clamp 26 to rotate, lock ring 54 to release from arm 44 and slipper clamp 26, and container lid 128 to rotate open.

It shall be appreciated that the components of the locking apparatus described in several embodiments herein may comprise any known materials in the field and be of any color, size and/or dimensions. It shall be appreciated that the components of the locking apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A locking apparatus for use in securing a lid of a refuse container in a closed position until access to the container is desired, the refuse container configured to be secured to a handle of the container located proximate a pivotal connection between the lid and a body of the container, the locking apparatus comprising:

a clamp assembly rotatably mounted to the handle of the container and comprising a fork member;

an arm comprising a first end mechanically coupled to the clamp assembly and a second end in contact with the lid;

a ring slidably mounted to the arm and clamp assembly;

a mounting bracket mechanically coupled to the handle of the container and connected to the clamp assembly by at least one spring, the mounting bracket comprising a pair of generally C-shaped members oriented substantially parallel to each other and connected together by a base plate, wherein space between the C-shaped members is sufficiently large to permit the clamp assembly and the arm to extend therethrough, an upper portion of the mounting bracket comprising at least one bumper;

a rod fastener comprising a first end coupled to the base plate of the mounting bracket and a second end coupled to the fork member; and a rod member slidably mounted to the rod fastener, wherein the rod member is disposed on the fork member to prevent movement of the arm and clamp assembly relative to the handle, thereby enabling the second end of the arm to secure the lid of the refuse container in the closed position, wherein the rod member is slidably adjusted away from the fork member to permit the clamp assembly and arm to rotate to permit the at least one bumper to release the ring from the arm and clamp assembly upon contact, thereby enabling the lid of the refuse container to be adjusted to an open position.

2. The locking apparatus of claim 1, wherein the clamp assembly comprises a pair of wings.

3. The locking apparatus of claim 2, wherein the mounting bracket is connected to the clamp assembly by a pair of springs, wherein a first spring comprises a first end coupled to the mounting bracket and a second end coupled to a first wing of the clamp assembly, wherein a second spring comprises a first end coupled to the mounting bracket and a second end coupled to a second wing of the clamp assembly.

4. The locking apparatus of claim 3, wherein the upper portion of the mounting bracket comprises a top bumper and a bottom bumper, wherein the top and bottom bumpers release the ring from the arm and clamp assembly upon contact.

5. The locking apparatus of claim 4, wherein the fork member of the clamp assembly comprises a pair of tines separated by a central slot, wherein the central slot is sufficiently large to receive the second end of the rod fastener.

6. The locking apparatus of claim 5, wherein the rod member comprises a block coupled to a rod extension, wherein the block is slidably mounted to the rod fastener.

7. The locking apparatus of claim 6, wherein each tine of the fork member comprises a lip, wherein each lip of each tine is configured to wrap around the block when disposed on the pair of tines.

8. The locking apparatus of claim 7, further comprising a cover disposed around the mounting bracket and comprising an opening sufficiently large to permit the rod extension of the rod member to extend therethrough.

9. The locking apparatus of claim 8, further comprising a brace coupled to a bottom of the cover, wherein the brace is configured to contact a face of the body of the container to enhance stability of the locking apparatus.

10. The locking apparatus of claim 9, wherein the arm comprises a step-shaped section configured to fit with a corresponding step-shaped slot in the ring.

* * * * *